US008794625B2

(12) United States Patent
Yamagata

(10) Patent No.: US 8,794,625 B2
(45) Date of Patent: Aug. 5, 2014

(54) SHEET SUPPLY DEVICE

(71) Applicant: Riso Kagaku Corporation, Tokyo (JP)

(72) Inventor: Akihiro Yamagata, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/936,509

(22) Filed: Jul. 8, 2013

(65) Prior Publication Data

US 2014/0027972 A1 Jan. 30, 2014

(30) Foreign Application Priority Data

Jul. 24, 2012 (JP) ..... 2012-163355

(51) Int. Cl.
*B65H 9/04* (2006.01)
*B65H 9/00* (2006.01)
*B65H 9/14* (2006.01)

(52) U.S. Cl.
CPC ..... *B65H 9/004* (2013.01); *B65H 9/006* (2013.01); *B65H 9/14* (2013.01)
USPC ..... 271/242; 271/270

(58) Field of Classification Search
CPC ..... B65H 5/062; B65H 9/004; B65H 9/006; B65H 9/14; B65H 29/125; B65H 2301/331; B65H 2601/272
USPC ..... 271/242, 270
See application file for complete search history.

(56) References Cited

U.S. PATENT DOCUMENTS

2009/0309291 A1* 12/2009 Yasui et al. ..... 271/9.01
2011/0316226 A1* 12/2011 Karikusa et al. ..... 271/226
2013/0009358 A1* 1/2013 Deno ..... 271/227
2013/0134663 A1* 5/2013 Deno ..... 271/228
2013/0316226 A1* 11/2013 Adharapurapu et al. ..... 429/185

FOREIGN PATENT DOCUMENTS

JP 2010-215389 9/2010

* cited by examiner

*Primary Examiner* — David H Bollinger
(74) *Attorney, Agent, or Firm* — Hamre, Schumann, Mueller & Larson, P.C.

(57) ABSTRACT

A sheet supply device includes registration rollers for feeding a print sheet to a print unit, feed rollers for feeding a print sheet to the registration rollers, and a controller for controlling the registration rollers and the feed rollers. The controller starts first rotation of the feed rollers to contact a leading edge of the print sheet to the registration rollers to form a slack with a predetermined slack amount, stops the first rotation after the slack is formed, starts rotation of the registration rollers after the first rotation is stopped to reduce a slack amount of the slack, and starts second rotation of the feed rollers after the rotation of the registration rollers is started so as to make the slack remained until a trailing edge of the print sheet passes through the feed rollers. According to the sheet supply device, noises during feeding print sheets can be reduced.

2 Claims, 3 Drawing Sheets

SHEET SUPPLY DEVICE

BACKGROUND OF THE INVENTION

1. Technical Field

The present invention relates to a sheet supply device for supplying print sheets (print media).

2. Background Arts

Conventionally, known is a sheet supply device that picks up a print sheet from a sheet supply tray and feeds the print sheet to a print unit by its registration rollers. In the sheet supply device, the print sheet is stalled in a state where its leading edge is contacted to a registration nip between the registration rollers to form a slack in the print sheet, so that an oblique feed of the print sheet can be compensated. Then, the registration rollers are driven to feed the print sheet to the print unit.

When the print sheet is fed forward by the registration rollers, the slack of the print sheet is expanded (i.e. back tension is applied to the print sheet) between the registration nip of the registration rollers and rollers located upstream from them. As a result, a noise (sheet expansion noise) may be generated due to the expansion of the slack.

A Japanese Patent Application Laid-Open No. 2010-215389 (Patent Document 1) discloses a sheet supply mechanism that also carries out an assistant operation. In the assistant operation, rollers located upstream from registration rollers are driven while the registration rollers are driven.

In the sheet supply mechanism, when supplying a print sheet form one of sheet supply trays disposed at a lower portion of a printer, the print sheet picked up from the one of the sheet supply trays is fed forward and then received by a pair of intermediate feed rollers. Then, the print sheet is stalled in a state where its leading edge is contacted to a registration nip between registration rollers by the pair of intermediate feed rollers to form a slack in the print sheet and then the rotation of the pair of intermediate feed rollers is stopped. Subsequently, the assistant operation is carried out by starting to drive the pair of intermediate feed rollers at the same time as starting to drive the registration rollers. According to this assistant operation, the print sheet is fed forward further by the registration rollers and the pair of intermediate feed rollers while the slack is kept.

By the above-explained assistant operation in the sheet supply mechanism of the Patent Document 1, the sheet expansion noise generated due to the expansion of the slack is reduced by keeping the slack amount of the initially-formed slack until a trailing edge of the print sheet passes through the intermediate feed rollers.

SUMMARY OF THE INVENTION

However, a noise (flapping noise) may be generated after all in the assistant operation of the Patent Document 1, because the slack of the print sheet is released just after the trailing edge of the print sheet passes through the intermediate feed rollers. For example, the trailing edge released just after passing through the intermediate feed rollers flaps a member(s) for guiding the print sheet, so that a flapping noise is generated. The further the print sheet is being slacked (the larger a slack amount is) at a time when the trailing edge of the print sheet is released, the larger such a noise becomes.

An object of the present invention is to provide a sheet supply device that can reduce noises.

An aspect of the present invention provides a sheet supply device that includes a pair of registration rollers for feeding a print sheet to a print unit of a printer, a pair of feed rollers for feeding a print sheet to the pair of registration rollers, and a controller configured to control the pair of registration rollers and the pair of feed rollers. The controller is operable: to start first rotation of the pair of feed rollers to contact a leading edge of the print sheet to a registration nip of the pair of registration rollers to form a slack of the print sheet with a predetermined slack amount, to stop the first rotation of the pair of feed rollers after the slack of the print sheet is formed, to start rotation of the pair of registration rollers after the first rotation of the pair of feed rollers is stopped to reduce a slack amount of the slack of the print sheet, and to start second rotation of the pair of feed rollers after the rotation of the pair of registration rollers is started so as to make the slack of the print sheet remained until a trailing edge of the print sheet passes through the pair of feed rollers.

According to the above aspect, the slack amount of the slack is reduced before the trailing edge of the print sheet passes through the pair of feed rollers. Therefore, the flapping noise to be generated just after the trailing edge of the print sheet passes through the pair of feed rollers is prevented. In addition, since the slack is made remained until the trailing edge of the print sheet passes through the pair of feed rollers, the sheet expansion noise is also prevented.

It is preferable that the controller is operable: to the controller is operable: to accelerate a feed speed by the rotation of the pair of registration rollers, to keep the feed speed by the rotation of the pair of registration rollers at a predetermined feed speed after the feed speed by the rotation of the pair of registration rollers reaches the predetermined feed speed, to accelerate a feed speed by the second rotation of the pair of feed rollers until the feed speed by the second rotation of the pair of feed rollers reaches the predetermined feed speed, and to keep the feed speed by the second rotation of the pair of feed rollers at the predetermined feed speed after the feed speed by the second rotation of the pair of feed rollers reaches the predetermined feed speed to rotate the pair of feed rollers synchronously with the pair of registration rollers; and the controller determines a start timing of the second rotation of the pair of feed rollers so that a reduced amount of the slack at a time when the feed speed by the second rotation of the pair of feed rollers reaches the predetermined feed speed is to be made smaller than the predetermined slack amount.

According to this configuration, the start timing of the second rotation of the pair of feed rollers is determined so that the slack is made remained at the time when the feed speed by the second rotation of the pair of feed rollers reaches the predetermined feed speed (i.e. the feed speed identical to the feed speed by the rotation of the pair of the registration rollers). The slack amount at the time when the feed speed by the second rotation of the pair of feed rollers reaches the predetermined feed speed is kept until the trailing edge of the print sheet passes through the pair of feed rollers. Therefore, the flapping noise and the sheet expansion noise are prevented surely.

DESCRIPTION OF THE EMBODIMENTS

Figure 1:
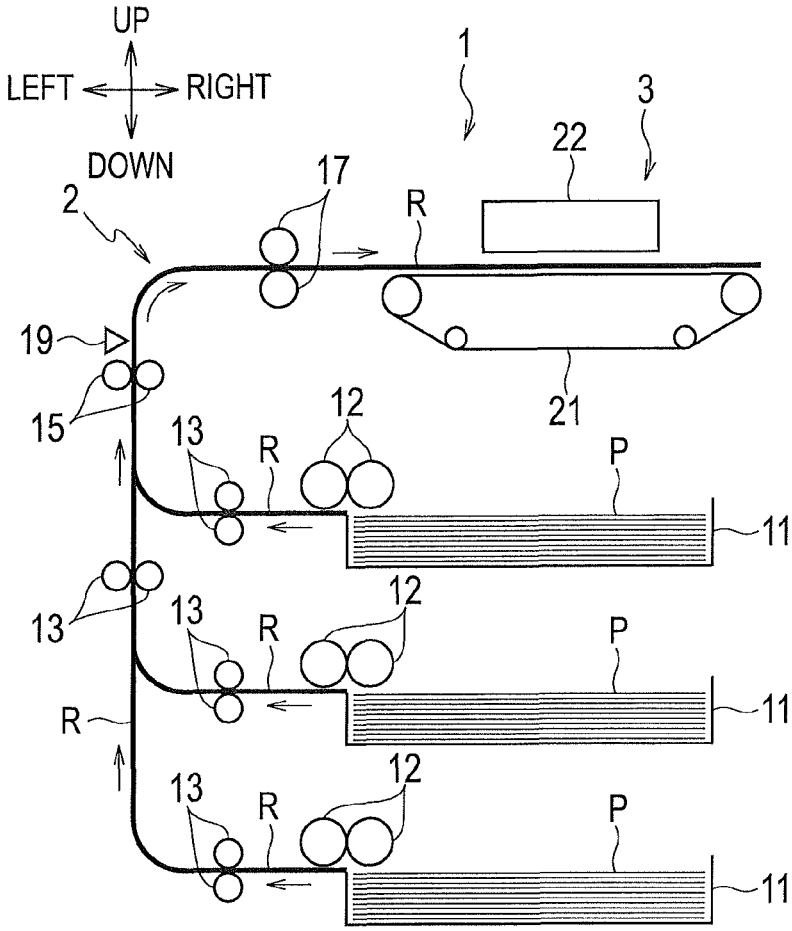
FIG. 1 is a schematic configurational diagram of a printer that includes a sheet supply device according to an embodiment.

Hereinafter, an embodiment will be explained with reference to the drawings. In the drawings, an identical or equivalent component is indicated by an identical reference number. But the drawings show components schematically, and it should be considered that the components in the drawings are not shown precisely as they are. In addition, actual dimensions of the components and actual dimensional proportions among the components may be shown differently in the drawings.

Further, the embodiment described below is explained as an example that specifically carries out the subject matter of the present invention, and the subject matter of the present invention is not limited to the embodiment. The embodiment may be modified within the scope of the claims (e.g. arrangement of the components may be changed from the embodiment).

Figure 2:
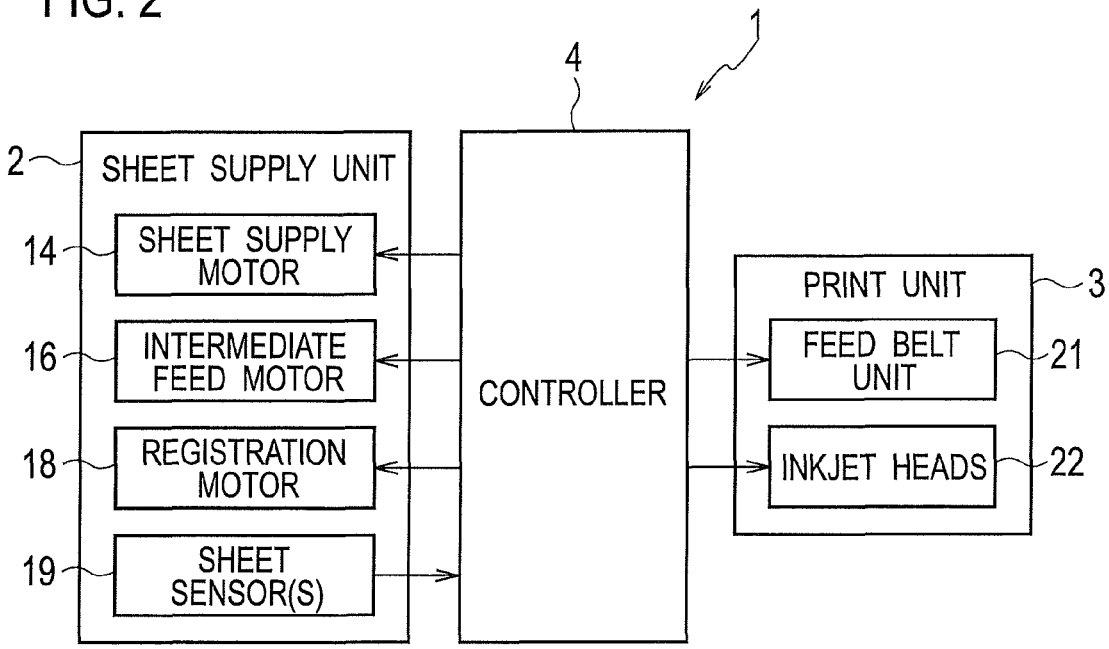
FIG. 2 is a block diagram showing a control system of the printer.

FIG. 1 shows a schematic configuration of a printer 1 that includes a sheet supply device according to an embodiment, and FIG. 2 shows a block diagram showing a control system of the printer 1. In the following descriptions, upward, downward, leftward and rightward are defined as shown by arrows shown in FIG. 1. In addition, paths shown by bold lines in FIG. 1 are feed paths R along which a print sheet(s) P as a print medium (media) is fed. Further, in the following descriptions, upstream and downstream is used in relation to the feed path(s) R.

As shown in FIGS. 1 and 2, the printer 1 includes a sheet supply unit 2, a print unit 3, and, a controller 4. Note that the sheet supply device is configured of the sheet supply unit 2 and the controller 4.

The sheet supply unit 2 supplies a print sheet(s) P to the print unit 3. The sheet supply unit 2 includes sheet trays 11, pairs of sheet supply rollers 12, pairs of upstream feed rollers 13, a sheet supply motor 14, a pair of intermediate feed rollers (served as a pair of feed rollers in claims 15, an intermediate feed motor 16, a pair of registration rollers 17, a registration motor 18, and a sheet sensor 19.

On the sheet trays 11, print sheets P as print media to be used for printing are stacked.

Each pair of sheet supply rollers 12 picks up the print sheets P stacked on the sheet tray 11 sheet by sheet, and then sequentially feeds them out to the feed path(s) R. The pairs of sheet supply rollers 12 are disposed above the sheet trays 11, respectively.

Each pair of upstream feed rollers 13 feeds the print sheet P that has fed out from the sheet supply tray 11 toward the pair of intermediate feed rollers 15. The pairs of the upstream feed rollers 13 are disposed along the feed paths R.

The sheet supply motor 14 drives the sheet supply rollers 12 and the upstream feed rollers 13 to rotate them. The sheet supply motor 14 can be connected and disconnected with the sheet supply rollers 12 and the upstream feed rollers 13 by clutches (not shown). The sheet supply rollers 12 and the upstream feed rollers 13 to be connected with the sheet supply motor 14 are changed over by the clutches.

The pair of intermediate feed rollers 15 receives the print sheet P that was fed out from any one of the sheet supply trays 11 and then fed along the feed path R by the upstream feed rollers 13, and feeds it to the registration rollers 17. The pair of intermediate feed rollers 15 assists the pair of registration rollers 17 by its operations synchronized with the pair of registration rollers 17. The pair of intermediate feed rollers 15 is disposed at a downstream section of the feed path(s) R.

The intermediate feed motor 16 drives the intermediate feed rollers 15 to rotate them.

The pair of registration rollers 17 stalls a print sheet P fed by the intermediate feed rollers 15, and then feeds it to the print unit 3 after a slack of the print sheet P is formed. The pair of registration rollers 17 is disposed downstream from the intermediate rollers 15.

The registration motor 18 drives the registration rollers 17 to rotate them.

The sheet sensor 19 detects a print sheet P at a position just downstream from the intermediate feed rollers 15, and then outputs the detection signal to the controller 4. The sheet sensor 19 is composed of an optical sensor including a light emitting element and a light receiving element.

The print unit 3 prints images on a print sheet P while feeding the print sheet P. The print unit 3 is disposed downstream from the sheet supply unit 2. The print unit 3 includes a feed belt unit 21, and inkjet heads 22.

The feed belt unit 21 feeds a print sheet P fed from the registration rollers 17 while holding it thereon by suctioning. Therefore, the feed belt unit 21 also includes a suction unit (not shown) for suctioning a print sheet P onto its continuous loop belt (feed belt) wound around rollers. The rollers are driven by a belt motor (not show) to circulate the feed belt, and thereby the print sheet P on the feed belt is fed forward.

The inkjet heads 22 are line-type inkjet heads each includes nozzles aligned along a direction (front-back direction) almost perpendicular to a feed direction of a print sheet P. The inkjet heads 22 are disposed above the feed belt unit 21. The inkjet heads 22 print images on a print sheet P fed by the feed belt unit 21 by injecting ink droplets onto the print sheet P.

The controller 4 controls operations of components in the printer 1. The controller 4 is configured to include a CPU, a RAM, a ROM and so on.

Specifically, the controller 4 executes printing on a print sheet(s) P by controlling the sheet supply unit 2 to supply the print sheet P to the print unit 3, controlling the feed belt unit 21 to feed the print sheet P, and controlling the inkjet heads 22 to inject ink droplets on the print sheet P.

In a sheet supply operation by the sheet supply unit 2, the controller 4 keeps the registration rollers 17 stopped at a time when a leading edge of a print sheet P fed by the intermediate feed rollers 15 is contacted to a registration nip between the registration rollers 17 to form a slack with a predetermined slack amount L. Subsequently, the controller 4 stops the intermediate feed rollers 15, and then starts to drive the registration rollers 17. While driving the registration rollers 17, the controller 4 carries out an assistant operation in which the intermediate feed rollers 15 assist the registration rollers 17. In the assistant operation, the controller 4 reduces the slack amount of the slack gradually, but makes the slack remained until a trailing edge of the print sheet P passes through the intermediate feed rollers 15.

Next, operations of the printer 1 will be explained.

Figure 3:
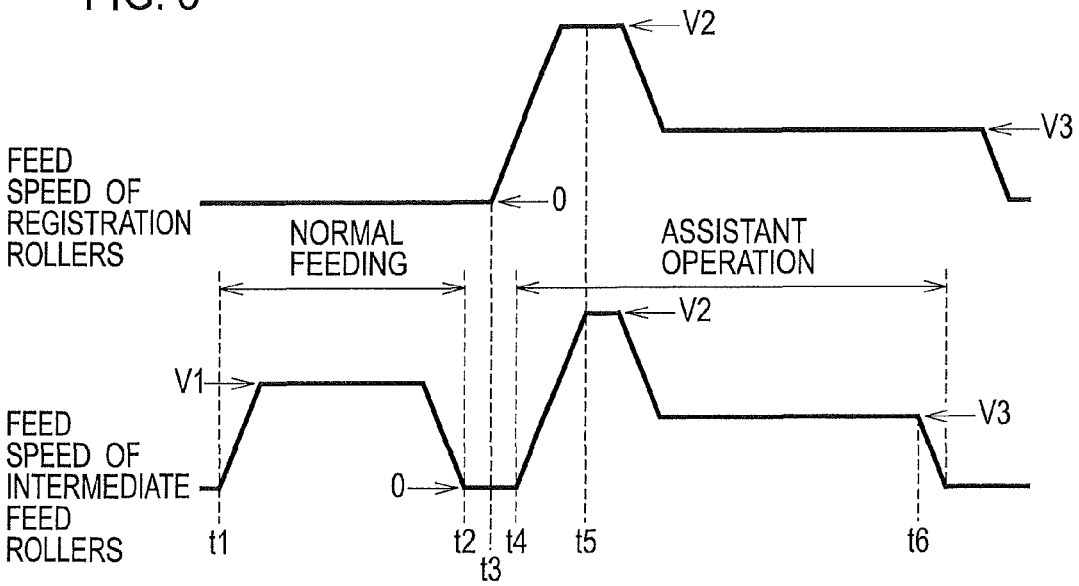
FIG. 3 is a timing chart showing changes of speeds of intermediate feed rollers and registration rollers.

FIG. 3 is a timing chart showing changes of feed speeds of the intermediate feed rollers 15 and the registration rollers 17. In FIG. 3, an upper line indicates the change of the feed speed of the registration rollers 17, and a lower line indicates the change of the feed speed of the intermediate feed rollers 15.

A printing operation is started at a time when the printer 1 receives print data from a personal computer, for example. After the printing operation is started, the controller 4 connects the sheet supply rollers 12 and the upstream feed rollers 13 (that are associate with the sheet tray 11 on which a print sheet P to be fed out is stacked) with the sheet supply motor 14 by controlling the above-explained clutches. According to this process, the print sheet P is picked up from the sheet tray 11 by the sheet supply rollers 12, and then fed toward the intermediate feed rollers 15 by the sheet supply rollers 12 and the upstream feed rollers 13.

In addition, the controller 4 drives the feed belt of the feed belt unit 21 circularly around the rollers. The controller 4 drives the feed belt unit 21 so as to feed the print sheet P at a printing feed speed Vg.

At a time t1 before the print sheet P fed by the upstream feed rollers 13 reaches the intermediate feed rollers 15, the controller 4 controls the intermediate feed motor 16 to start rotations of the intermediate feed rollers 15. When the feed speed of the intermediate feed rollers 15 reaches a predetermined feed speed V1, the controller 4 keeps the feed speed V1 for a predetermined time period, and then stops the intermediate feed motor 16. According to this process, the rotations of the intermediate feed rollers 15 are stopped (at a time t2). During a normal feeding in the time period from t1 to t2, the intermediate feed rollers 15 feed the print sheet P toward the registration rollers 17, and then contacts a leading edge of the print sheet P to the registration nip between the registration rollers 17 to form a slack of the print sheet P with a predetermined slack amount L.

After stopping the intermediate feed rollers 15, the controller 4 starts rotations of the registration rollers 17 at a time t3 by controlling the registration motor 18. When the feed speed of the registration rollers 17 reaches a predetermined feed speed V2, the controller 4 keeps the feed speed V2 for a predetermined time period. Then, the controller 4 reduces the feed speed of the registration rollers 17 to a feed speed V3 by controlling the registration motor 18. The feed speed V3 is almost equal to the above-explained printing feed speed Vg. The controller 4 reduces the feed speed of the registration rollers 17 to the feed speed V3 before the leading edge of the print sheet P reaches the feed belt unit 21.

Subsequently, at a time when a trailing edge of the print sheet P passes through the registration nip between the registration rollers 17, the controller 4 stops the rotations of the registration rollers 17 by stopping the registration motor 18.

In addition, after starting the rotations of the registration rollers 17, the controller 4 starts rotations of the intermediate feed rollers 15 at a time t4 by controlling the intermediate feed motor 16 in order to carry out the above-mentioned assistant operation. After starting the rotations of the intermediate feed rollers 15, the controller 4 accelerates the feed speed of the intermediate feed rollers 15 with acceleration identical to that applied to the registration rollers 17.

When the feed speed of the intermediate feed rollers 15 reaches the feed speed V2 identical to that of the registration rollers 17 at a time t5, the controller 4 starts to control the intermediate feed motor 16 to synchronize the intermediate feed rollers 15 with the registration rollers 17. Then, the intermediate feed rollers 15 are made synchronized with the registration rollers 17, so that the feed speed of the intermediate feed rollers 15 is reduced from the feed speed V2 to the feed speed V3.

During the time period from the time t3 to the time t5, the slack of the print sheet P is gradually flattened due to the difference between the feed speed of the registration rollers 17 and the feed speed of the intermediate feed rollers 15. A start timing (time t4) of the assistant operation is determined so that the slack of the print sheet P is to be made remained at the time t5 when the feed speed of the intermediate feed rollers 15 reaches the feed speed V2. A method for determining the start timing (time t4) of the assistant operation will be explained later.

Subsequently, the controller 4 stops the rotation of the intermediate feed rollers 15 by controlling the intermediate feed motor 16 at a time t6 when the trailing edge of the print sheet P has passed through the intermediate feed rollers 15. Here, the controller 4 judges that the trailing edge of the print sheet P has passed through the intermediate feed rollers 15 when the sheet sensor 19 detects the trailing edge of the print sheet P. The slack amount of the print sheet P at the time t5 is kept until the trailing edge of the print sheet P has passed through the intermediate feed rollers 15.

When the print sheet P is fed from the registration rollers 17 to the feed belt unit 21, the controller 4 controls the inkjet heads 22 to inject ink droplets onto the print sheet P. According to this process, images are printed on the print sheet P.

Next, the method for determining the start timing (time t4) of the assistant operation will be explained.

As explained above, the start timing (the time t4) of the assistant operation by the intermediate feed rollers 15 is determined so that the slack of the print sheet P is to be made remained at the time t5 when the feed speed of the intermediate rollers 15 reaches the feed speed V2. Namely, the controller 4 determines the start timing (time t4) of the assistant operation so that a reduced amount of the slack (reduced slack amount Ld) in a time period from the time t3 when the rotation of the registration rollers 17 is started to the time t5 when the feed speed of the intermediate feed rollers 15 reaches the feed speed V2 is made smaller than the predetermined slack amount L of the initially-formed slack.

Here, a slack mount of the print sheet P to be remained at the time t5 is defined as a to-be-remained slack amount Lr. A following equation (1) is satisfied.

$$L-Ld=Lr \tag{1}$$

Figure 4:
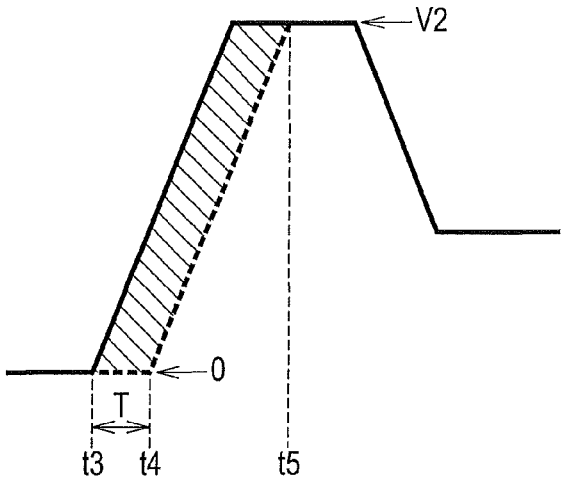
FIG. 4 is a timing chart explaining a start timing of an assistance operation by the intermediate feed rollers.

The reduced slack amount Ld corresponds to an area indicated by hatched lines in FIG. 4. Namely, the reduced slack amount Ld corresponds to a difference between a feed amount by the registration rollers 17 and a feed amount by the intermediate feed rollers 15 during the time period t3 to t5. In FIG. 4, a bold solid line indicates a change of the feed speed of the registration rollers 17, and a bold dotted line indicates a change of the feed speed of the intermediate feed rollers 15.

As explained above, the acceleration applied to the intermediate feed rollers 15 until the feed speed of the intermediate feed rollers 15 reaches the feed speed V2 is made identical to that applied to the registration rollers 17 until the feed speed of the registration rollers 17 reaches the feed speed V2. Here, the time period t3 to t4 is defined as T. A following equation (2) is satisfied.

$$Ld=T\times V2 \tag{2}$$

The above equations (1) and (2) lead to a following equation (3).

$$T=(L-Lr)/V2 \tag{3}$$

T (i.e. the time t4) can be sought based on the above equation (3). The time t4 is determined, as the start timing of the assistant operation by the intermediate feed rollers 15, by adding T sought from the above equation (3) to the time t3 when the rotations of the registration rollers 17 are started.

Figure 5:
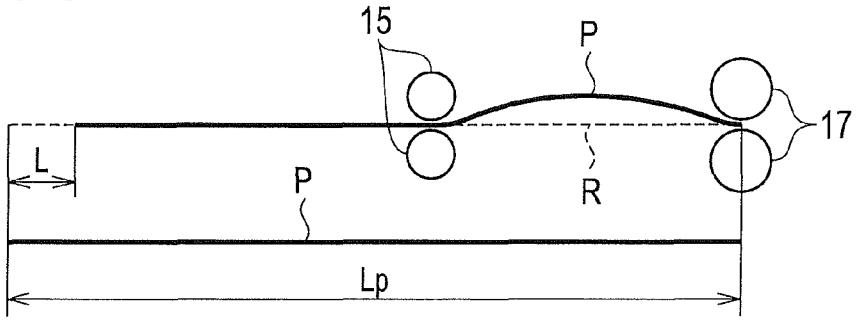
FIG. 5 is a side view for explaining a slack amount.

As shown in FIG. 5, the predetermined slack amount L corresponds to a shortened length, relative to an original length Lp of the print sheet P, when the print sheet P is contacted to the registration nip between the registration rollers 17 to form the slack with an amount appropriate for compensation of an oblique feed of the print sheet P. The predetermined slack amount L is set according to a type of the print sheet P and so on. Note that the feed path R actually curves between the intermediate feed rollers 15 and the registration rollers 17, but it is shown linearly in FIG. 5 for the sake of expedience.

The to-be-remained amount Lr is a shortened length, relative to an original length Lp of the print sheet P, at the time t5 when the feed speed of the intermediate feed rollers 15 reaches the feed speed V2 identical to that of the registration rollers 17. The to-be-remained amount Lr is determined as a minimum slack mount required for avoiding the back tension on the print sheet P. For example, the predetermined slack amount L of the initially-formed slack is set to 6 mm, and the to-be-remained amount Lr is set to 1 mm.

Figure 6:
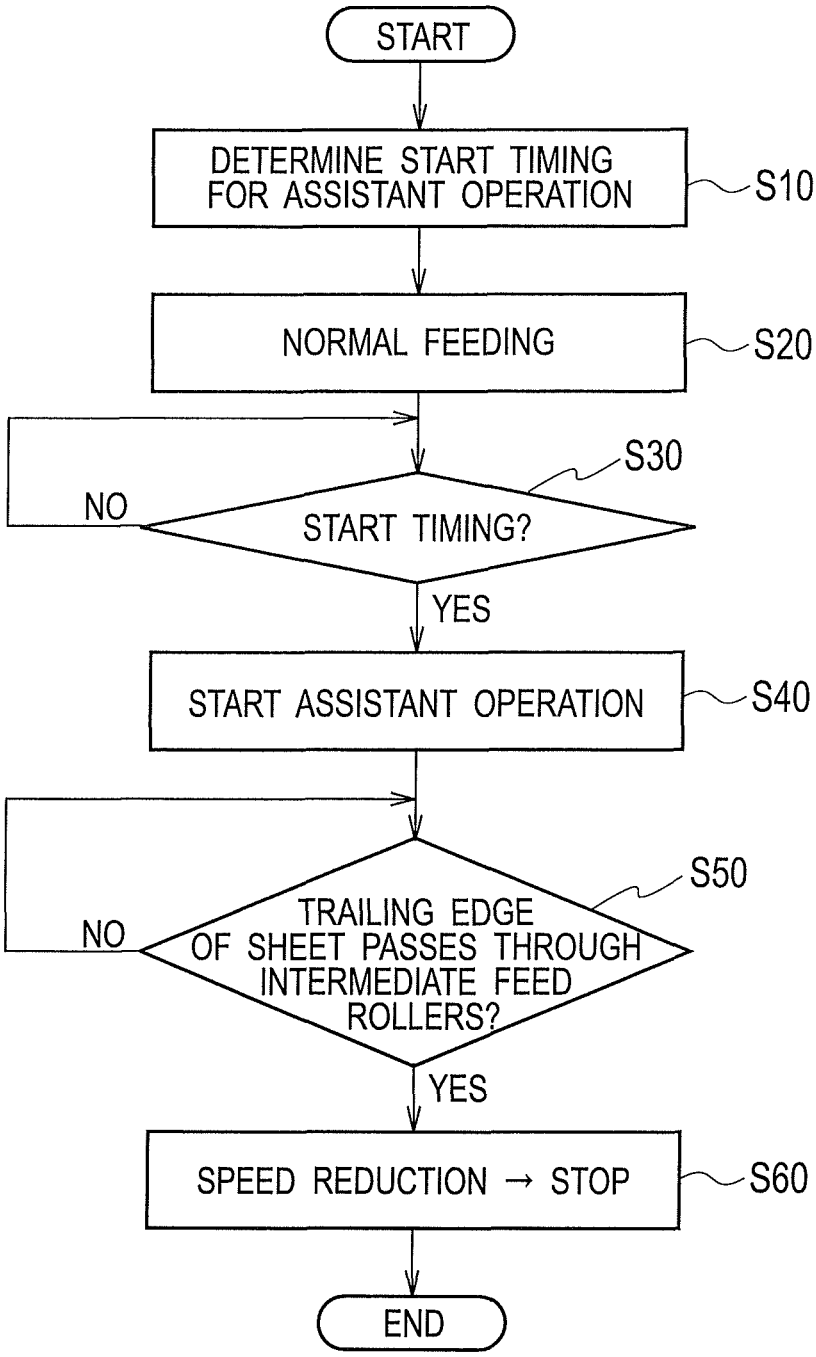
FIG. 6 is a flowchart for explaining a control of the intermediate feed rollers.

Next, control processes for the assistant operation by the intermediate feed rollers 15 will be explained with reference to a flowchart shown in FIG. 6.

After the printing operation is started, the controller 4 determines the start timing (time t4) of the assistant operation by the intermediate feed rollers 15 (step S10). Specifically, the controller 4 seeks T based on the above equation (3), and determines the start timing (time t4) by adding T to the time t3 when the rotations of the registration rollers 17 are started.

Subsequently, the controller 4 controls the intermediate feed rollers 15 to operate the normal feeding (step S20). By the normal feeding, a print sheet P on one of the sheet trays 11 is picked up and then fed toward the registration rollers 17. A leading edge of the print sheet P is contacted to the registration nip between the registration rollers 17 to form a slack with the predetermined slack amount L. Then, the controller 4 starts rotations of the registration rollers 17.

Subsequently, the controller 4 judges whether or not it gets to the start timing of the assistant operation determined in step S10 (step S30). If it is judged that it does not yet get to the start timing of the assistant operation (No in step S30), the controller 4 repeats the process of the step S30.

If it is judged that it gets to the start timing of the assistant operation (Yes in step S30), the controller 4 starts the assistant operation by the intermediate feed rollers 15 (step S40). Specifically, the controller 4 starts rotation of the intermediate feed rollers 15 by controlling the intermediate feed motor 16 to accelerate the feed speed of the intermediate feed rollers 15 with acceleration identical to that applied to the registration rollers 17. After the feed speed of the intermediate feed rollers 15 reaches the feed speed V2 identical to that of the registration rollers 17, the controller 4 controls the intermediate feed motor 16 to synchronize the intermediate feed rollers 15 with the registration rollers 17.

Subsequently, the controller 4 judges whether or not a trailing edge of the print sheet P has passed through the intermediate feed rollers 15 (step S50). Here, the controller 4 judges that the trailing edge of the print sheet P has passed through the intermediate feed rollers 15 when the sheet sensor 19 detects the trailing edge of the print sheet P. If it is judged that the trailing edge of the print sheet P doesn't have passed through the intermediate feed rollers 15 (No in step S50), the controller 4 repeats the process of the step S50.

If it is judged that the trailing edge of the print sheet P has passed through the intermediate feed rollers 15 (Yes in step S50), the controller 4, by controlling the intermediate feed motor 16, starts to reduce the feed speed of the intermediate feed rollers 15 from the feed speed V3 to stop the rotations of the intermediate feed rollers 15 (step S60). As a result, the rotations of the intermediate feed rollers 15 is stopped, so that the assistant operation is finished.

According to the above-explained assistant operation, the slack amount of the print sheet P is reduced to the to-be-remained slack amount Lr until the time t5 when the feed speed of the intermediate feed rollers 15 reaches the feed speed V2 identical to that of the registration rollers 17. But, the to-be-remained slack amount Lr is made remained until the trailing edge of the print sheet P has passed through the intermediate feed rollers 15.

As explained above, in the assistant operation done by the printer 1 according to the present embodiment, the slack mount of the print sheet P is reduced from the predetermined slack amount L, but the slack is made remained until the trailing edge of the print sheet P has passed through the intermediate feed rollers 15. By reducing the slack amount of the print sheet P from the predetermined slack amount L, the flapping noise to be generated just after the trailing edge of the print sheet P passes through the intermediate feed rollers 15 can be prevented. In addition, the slack of the print sheet P is made remained until the trailing edge of the print sheet P passes through the intermediate feed rollers 15, so that the sheet expansion noise due to back tension can be also prevented. As explained above, noises can be prevented according to the printer 1.

Specifically, the controller 4 determines the start timing (time t4) of the assistant operation so that the reduced slack amount Ld in the time period from the time t3 when the rotation of the registration rollers 17 is started to the time t5 when the feed speed of the intermediate feed rollers 15 reaches the feed speed V2 is to be made smaller than the predetermined slack amount L of the initially-formed slack. Namely, the controller 4 can determine the start timing (time t4) of the assistant operation so that the slack of the print sheet P is made remained at the time t5 when the feed speed of the intermediate feed rollers 15 reaches the feed speed V2. In addition, the slack amount at the time t5 when the feed speed of the intermediate feed rollers 15 reaches the feed speed V2 (i.e. the to-be-remained slack amount Lr) can be made remained until the trailing edge of the print sheet P has passed through the intermediate feed rollers 15. As a result, the flapping noise can be prevented, and the sheet expansion noise can be also prevented.

Note that the printer 1 is an inkjet type printer in the present embodiment. However, a printer including a sheet supply device according to the present invention is not limited to this printer type.

The present invention is not limited to the above-mentioned embodiment, and it is possible to embody the present invention by modifying its components in a range that does not depart from the scope thereof Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-163355, filed on Jul. 24, 2012, the entire content of which is incorporated herein by reference.

What is claimed is:

1. A sheet supply device comprising:

a pair of registration rollers for feeding a print sheet to a print unit of a printer;

a pair of feed rollers for feeding a print sheet to the pair of registration rollers; and a controller configured to control the pair of registration rollers and the pair of feed rollers, wherein the controller is operable to:

start first rotation of the pair of feed rollers to contact a leading edge of the print sheet to a registration nip of the pair of registration rollers to form a slack of the print sheet with a predetermined slack amount, stop the first rotation of the pair of feed rollers after the slack of the print sheet is formed, start rotation of the pair of registration rollers after the first rotation of the pair of feed rollers is stopped to reduce a slack amount of the slack of the print sheet, and start second rotation of the pair of feed rollers after the rotation of the pair of registration rollers is started so as to make the slack of the print sheet remained until a trailing edge of the print sheet passes through the pair of feed rollers.

2. The sheet supply device according to claim 1, wherein the controller is operable to:

accelerate a feed speed by the rotation of the pair of registration rollers, keep the feed speed by the rotation of the pair of registration rollers at a predetermined feed speed after the feed speed by the rotation of the pair of registration rollers reaches the predetermined feed speed, accelerate a feed speed by the second rotation of the pair of feed rollers until the feed speed by the second rotation of the pair of feed rollers reaches the predetermined feed speed, and keep the feed speed by the second rotation of the pair of feed rollers at the predetermined feed speed after the feed speed by the second rotation of the pair of feed rollers reaches the predetermined feed speed to rotate the pair of feed rollers synchronously with the pair of registration rollers, wherein the controller determines a start timing of the second rotation of the pair of feed rollers so that a reduced amount of the slack at a time when the feed speed by the second rotation of the pair of feed rollers reaches the predetermined feed speed is to be made smaller than the predetermined slack amount.

* * * * *